US010968653B2

(12) United States Patent
Vemuri et al.

(10) Patent No.: US 10,968,653 B2
(45) **Date of Patent: *Apr. 6, 2021**

(54) BUCKLING RESISTANT SPRING CLAD BAR

(71) Applicants: Venkata Rangarao Vemuri, Hyderabad (IN); Badri K Prasad, Pleasanton, CA (US)

(72) Inventors: Venkata Rangarao Vemuri, Hyderabad (IN); Badri K Prasad, Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,905

(22) Filed: Apr. 15, 2019

(65) Prior Publication Data

US 2019/0301194 A1 Oct. 3, 2019

Related U.S. Application Data

(63) Continuation-in-part of application No. 15/609,049, filed on May 31, 2017, now Pat. No. 10,260,251.

(51) Int. Cl.

| | |
|---|---|
| ***E04H 9/02*** | (2006.01) |
| ***E04C 5/06*** | (2006.01) |
| ***E04C 3/34*** | (2006.01) |
| ***E04C 5/16*** | (2006.01) |

(52) U.S. Cl.

CPC ..... *E04H 9/025* (2013.01); *E04C 3/34* (2013.01); *E04C 5/0609* (2013.01); *E04C 5/0618* (2013.01); *E04C 5/161* (2013.01)

(58) Field of Classification Search

CPC ..... E04H 9/025; E04C 5/0609; E04C 5/0618; E04C 5/161; E04C 3/34

USPC ..... 52/167.1, 167.4, 167.6, 167.8

See application file for complete search history.

(56) References Cited

U.S. PATENT DOCUMENTS

| | | | | |
|---|---|---|---|---|
| 1,260,331 A * | 3/1918 | Collings | E04B 1/4107 | 52/699 |
| 2,055,000 A * | 9/1936 | Bacigalupo | E04H 9/023 | 52/167.6 |
| 2,950,576 A * | 8/1960 | Rubenstein | E04B 1/383 | 52/223.13 |
| 3,367,084 A * | 2/1968 | Reiland | E04O 5/16 | 52/649.7 |
| 3,592,243 A * | 7/1971 | Fukushima | B21F 27/122 | 140/92.2 |
| 3,606,704 A * | 9/1971 | Denton | E04F 15/024 | 52/167.8 |

(Continued)

FOREIGN PATENT DOCUMENTS

| | | |
|---|---|---|
| EP | 557979 A1 * | 9/1993 |
| EP | 848111 A1 * | 12/1996 |

*Primary Examiner* — Brent W Herring

(74) *Attorney, Agent, or Firm* — Raghunath S. Minisandram

(57) ABSTRACT

A buckling resistant spring clad bar (BRSCB) assembly is described. The BRSCB assembly includes a plurality of bars arranged to form a perimeter, each of the plurality of bars having a top end and a bottom end. A plurality of springs are provided, wherein at least one of the plurality of springs is wrapped around each of the plurality of bars. A diameter of the at least one of the plurality of spring is greater than a diameter of the each of the plurality of bars. The at least one of the plurality of springs is wrapped around each of the plurality of bars in close contact to provide buckling resistance against a load applied over each of the plurality of bars.

24 Claims, 14 Drawing Sheets

(56) References Cited

U.S. PATENT DOCUMENTS 3,638,386 A * 2/1972 Waerner ..... B66C 1/666 52/704
3,716,210 A * 2/1973 Fukushima et al. .. B21F 27/121 245/1
3,794,277 A * 2/1974 Smedley ..... F16F 7/127 248/548
3,906,689 A * 9/1975 Nakayama ..... E04H 9/021 52/167.6
4,496,130 A * 1/1985 Toyama ..... E04H 9/023 248/585
4,554,767 A * 11/1985 Ikonomou ..... E02D 27/34 52/167.9
4,716,696 A * 1/1988 Yacoboni ..... E02D 27/42 52/167.1
4,736,555 A * 4/1988 Nagare ..... E04F 15/02452 248/544
4,766,708 A * 8/1988 Sing ..... E04B 1/98 248/585
5,103,605 A * 4/1992 Sul ..... E04H 9/021 52/167.1
5,469,679 A * 11/1995 Burkard ..... B65C 11/00 138/96 R
7,175,150 B2 * 2/2007 Chi ..... F16F 3/10 248/562
7,188,452 B2 * 3/2007 Sridhara ..... E04H 9/02 188/266
7,243,466 B2 * 7/2007 Bloch-Fortea ..... E04H 9/021 52/167.1
7,565,774 B2 * 7/2009 Shizuku ..... E04H 9/022 248/565
8,291,650 B2 * 10/2012 Vreeland ..... E04H 9/021 248/562
8,317,444 B1 * 11/2012 Hensley ..... F16B 35/04 411/107
8,359,793 B2 * 1/2013 Zeevi ..... F16F 15/067 248/618
8,453,412 B2 * 6/2013 Toedte ..... E04B 1/415 52/166
8,870,506 B2 * 10/2014 Hensley ..... F16B 35/04 411/82
9,316,279 B2 * 4/2016 Meisel ..... E04H 9/021
9,394,967 B2 * 7/2016 Tu ..... F16F 15/067
9,677,266 B2 * 6/2017 Hensley ..... F16B 35/04
10,106,979 B2 * 10/2018 Lee ..... E04G 23/0218
10,260,251 B2 * 4/2019 Rao Vemuri ..... E04H 9/025
2003/0089050 A1 * 5/2003 Tipping ..... E04G 11/48 52/127.2
2005/0086877 A1 * 4/2005 Bloch-Fortea ..... E04H 9/021 52/167.1
2006/0137264 A1 * 6/2006 Shizuku ..... E04H 9/022 52/167.7
2006/0179729 A1 * 8/2006 Li ..... E04H 9/02 52/167.7
2011/0131894 A1 * 6/2011 Vreeland ..... E04H 9/021 52/126.6
2012/0047822 A1 * 3/2012 Zeevi ..... E04H 9/021 52/167.4
2013/0047546 A1 * 2/2013 Toedte ..... E04B 1/415 52/699
2013/0104483 A1 * 5/2013 Hensley ..... F16B 35/04 52/466
2013/0152490 A1 * 6/2013 Hinchman ..... E04H 9/02 52/167.3
2015/0023755 A1 * 1/2015 Hensley ..... F16B 35/04 411/107
2016/0097205 A1 * 4/2016 Ohshima ..... E04B 5/43 52/167.1
2016/0348472 A1 * 12/2016 Gosselin ..... E21B 37/00
2017/0138510 A1 * 5/2017 Kim ..... F16F 15/085
2017/0145686 A1 * 5/2017 Lee ..... E04B 1/98
2017/0350150 A1 * 12/2017 Rudlinger ..... E04H 9/021
2018/0100322 A1 * 4/2018 Rao Vemuri ..... E04H 9/025

* cited by examiner

BUCKLING RESISTANT SPRING CLAD BAR

RELATED APPLICATIONS

This application is a continuation-in-part application of US patent application with Ser. No. 15/609,049 filed on May 31, 2017, and entitled "Buckling Resistant Spring Clad Bar" which claims priority to India Patent Application No. 201641034642, filed on Oct. 10, 2016, and entitled "Buckling Resistant Spring Clad Bar". Application Ser. No. 15/609,049 filed on May 31, 2017 is incorporated herein by reference in its entirety. Application No. 201641034642 filed on Oct. 10, 2016 is incorporated herein by reference in its entirety.

FIELD OF INVENTION

The embodiment herein generally relates to the field of structures subject to non-dynamic/dynamic forces such as earthquake resistant structures. More specifically, the invention provides a buckling resistant system of bar assembly (Buckling Resistant Spring Clad Bar (BRSCB)) to withstand both compression and tension (cyclic as well as monotonic) in which the assembly is embedded in required medium such as reinforced concrete/steel columns/soil/other medium which acts a sleeve.

BACKGROUND

Seismic load resistant buildings are developed to avoid loss incurred due to natural disasters. According to building codes, earthquake-resistant structures are developed so as to withstand strong earthquakes of a certain probability. Avoiding the collapse of a building, in the event of a natural disaster can help minimize the loss of lives. So many natural disaster resistant structures are formed based on the severity of the potential disaster.

Globally, different systems are developed to withstand shaking of the structures with some damage being accepted as collateral. In some structural designs, the base of the building is isolated and in some other cases 'structural vibration control technologies' are utilized in order to reduce the impact of forces and resulting deformations. Commonly displacement control systems are installed for making earthquake resistant buildings. In implicit systems, measures are embedded (ex: reinforced concrete structures with closure spacing of ties in potential damage zones of lateral load resisting elements) and placed externally in explicit systems (seismic resistant bracings in buildings, viscous resistant dampers in vehicles).

The reinforced concrete, an example of implicit system, is usually made of steel reinforcing bars (rebar), tied at closure intervals with lateral reinforcement (hoops) and embedded passively in the concrete before setting. Provision of ties delays buckling of rebar and closure spacing of ties improves the cyclic response ductility up to a limited displacement and specified load drop beyond which structure loses strength at a rapid rate. Hence, there exists a need for improving behavior/performance of implicit systems to achieve improved seismic performance of reinforced concrete buildings.

According to one of the prior arts for the explicit system, which has advantage in compression only, when the core (bar) starts buckling, it establishes contact with the sleeve and induces hoop stress. At higher loads, subject to bending capacity of sleeve, core goes into multiple modes of curvature. There is a need for a system to effectively reduce buckling of the bars to improve response in compression and also exhibit similar resistance to tension to withstand cyclic loads, for example, due to earthquake or seismic event. Further, the optimization in material consumption shall also be the focus.

Therefore, there exists a need in prior art to develop an optimized system for improving cyclic response for both explicit and implicit systems. Such systems that resist cyclic response also form a suitable alternative to needs in related fields such as shock absorption systems/blast/impact resistant systems.

OBJECTS OF THE INVENTION

Some of the objects of the present disclosure are described herein below:

A main object of the present invention is to provide a Spring Clad Bar (BRSCB) to reduce buckling of the bars and hence reduce resultant effects on to the core so that it can withstand higher loads in compression and tension as a composite assembly to use as implicit/explicit systems and that leads to significant improvement in the post-elastic behavior due to enhanced ductility without strength degradation for lateral loads (seismic and wind loads).

Another object of the present invention is to provide a BRSCB with a one-way spring wrapped around a bar to allow close contact and hence allow uniform lateral restraint to bar to use as implicit/explicit systems.

Still another object of the present invention is to provide a BRSCB with a one-way spring wrapped around a bar and securely clamped at multiple locations with at least at ends using grips to allow composite action in both compression and tension to use as implicit/explicit systems.

Yet another object of the present invention is to provide a BRSCB with counter spring clad system with a pair of equal coil diameter but of opposing springs, wrapped around a bar to provide more uniform lateral restraint to bar to use as implicit/explicit systems.

Another object of the present invention is to provide a BRSCB with counter spring clad system with a pair of equal coil diameter but of opposing springs, wrapped around a bar and securely clamped at multiple locations with at least ends using grips to allow composite action in both compression and tension to use as implicit/explicit systems.

Another object of the present invention is to provide a BRSCB system with a one-way spring wrapped around a bar that is embedded in a sleeve to act as implicit/explicit system.

Another object of the present invention is to provide a BRSCB system with a one-way spring wrapped around a bar and securely clamped at multiple locations with grips at least at ends that is embedded in a sleeve to act as implicit/explicit system.

Another object of the present invention is to provide a BRSCB with counter spring clad system with a pair of equal coil diameter but of opposing springs, wrapped around a bar that is embedded in a sleeve to act as implicit/explicit system.

Another object of the present invention is to provide a BRSCB with counter spring clad system with a pair of equal coil diameter but of opposing springs, wrapped around a bar and securely clamped at multiple locations with grips at least at ends that is embedded in a sleeve to act as an implicit/explicit system.

Another object of the present invention is to provide a BRSCB system with a one-way spring wrapped around a bar that is embedded in a perforated sleeve for passive embedment in concrete/soils for using as implicit/explicit system.

Another object of the present invention is to provide a BRSCB system with a one-way spring wrapped around a bar and securely clamped at multiple locations with grips at least at ends that is embedded in a perforated sleeve for using as implicit/explicit system Another object of the present invention is to provide a BRSCB system with a one-way spring wrapped around a bar and securely clamped at multiple locations with grips at least at ends that is embedded in a perforated sleeve for use as implicit/explicit system Another object of the present invention is to provide a BRSCB with opposing spring clad system with a pair of equal coil diameter but of opposing spring, wrapped around a bar and securely clamped at multiple locations with grips at least at ends that is embedded in a perforated sleeve use as implicit/explicit system Another object of the present invention is to provide multiple BRSCB with one-way spring clad system wrapped around each bar that is embedded in a sleeve for use as implicit/explicit system.

Another object of the present invention is to provide multiple BRSCB with opposing spring clad system with a pair of equal coil diameter but of opposing spring, wrapped around each bar that is embedded in a sleeve for use as implicit/explicit system Another object of the present invention is to provide a BRSCB with opposing spring clad system with a pair of equal coil diameter but of opposing springs, wrapped around multiple bar placed in the body of a suitable geometric shape (circular/square etc.) for use as implicit for deformation control.

Another object of the present invention is to provide a BRSCB with counter spring clad system with a pair of equal coil diameter but of opposing spring, wrapped around multiple bar each wrapped with one-way spring with or without grips placed in the body of a suitable geometric shape (circular/square etc.) for use as implicit for deformation control wherein peripheral counter spring clad system acts a tie for passive embodiment in suitable medium such as concrete etc.

Another object of the present invention is to provide a BRSCB with counter spring clad system with a pair of equal coil diameter but of opposing spring, wrapped around multiple bar each wrapped with counter spring clad system with a pair of equal coil diameter but of opposing spring with or without grips placed in the body of a suitable geometric shape (circular/square etc.) for use as implicit for deformation control wherein peripheral counter spring clad system acts a tie for passive embodiment in suitable medium such as concrete etc.

Another object of the present invention is to provide a BRSCB that can be applicable in shock absorption systems, impact resistant systems, and seismic resistant systems.

The other objects and advantages of the present invention will be apparent from the following description when read in conjunction with the accompanying drawings, which are incorporated for illustration of preferred embodiments of the present invention and are not intended to limit the scope thereof.

SUMMARY OF THE INVENTION

In view of the foregoing, an embodiment herein provides BRSCB to improve lateral confinement of compression system uniformly to withstand both compression and tension. The BRSCB comprises, a plurality of bar, a plurality of one-way spring, and a plurality of peripheral ties; wherein the bar is a confinable geometrical shape of any material; wherein the one-way spring wrapped around the bar; wherein the diameter of the one-way spring is greater than diameter of the bar; and wherein the bars are securely tied by the peripheral ties at multiple locations to maintain stability of the system. The BRSCB further comprises the option of having of a plurality of grips; wherein the grips provided at least at the end of the bar to hold the assembly firmly and to avoid end slippage of the one-way spring. BRSCB further comprises the option of having increased gap between the bar and the spring.

According to an embodiment, the BRSCB further comprises a plurality of intermediate grips connected between the one-way spring and the bar to improve stiffness of the assembly, plurality of bars each cladded with one way spring and plurality of intermediate grips. The multiple BRSCB can be assembled as a cage of square or rectangular or circular or any shaped column according to a structure requirement; wherein the structure comprises multiple bars, each cladded with one-way spring placed on the circumference and in the body as desired for a given shape of column, securely tied with peripheral ties. Further, the BRSCB can be placed centrally to a sleeve with a gap between one-way spring and the sleeve of suitable material; wherein the gap is grouted to get the performance desired of a reinforced concrete specimen. Further, the sleeve can be either perforated sleeve or plain sleeve. The BRSCB formed with multiple bars and each wrapped with the one-way springs are housed in the sleeve with a gap. Further, the BRSCB assembly can be embedded in the concrete structure with or without sleeve. Gap between spring and bar is either pre-grouted or grout fills during concrete.

According to another embodiment, a BRSCB to improve lateral confinement of compression system uniformly to withstand both compression and tension. Further, the system is designed in such a way so as to improve ductility of the structure when embedded in reinforced concrete. The BRSCB comprises, a plurality of bar, a plurality of counter springs of same coil diameter, a plurality of end grips, and a plurality of peripheral ties; wherein the bar is a confinable geometrical shape of any material; wherein the counter springs wrapped around bar; wherein the coil diameter of the spring is greater than diameter of the bar; wherein the end grips are provided at both the end of the bar to hold the assembly firmly and to avoid end slippage of the opposing springs; and wherein the bars are securely tied by the peripheral ties at multiple locations to maintain stability of the system.

According to another embodiment, the BRSCB can be placed central to a sleeve with a gap between the opposing spring and the sleeve; wherein the gap is grouted to get the desired performance as that of reinforced concrete specimen. Further, the BRSCB can also be formed with multiple bars and each wrapped with clockwise and anticlockwise opposing springs housed in the sleeve with a gap. Further, the BRSCB assembly can be embedded in the concrete structure with or without sleeve. The gap between the spring and bar is either pre-grouted or grout fills during concrete.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION OF THE PREFERRED EMBODIMENTS

Figure 1A:
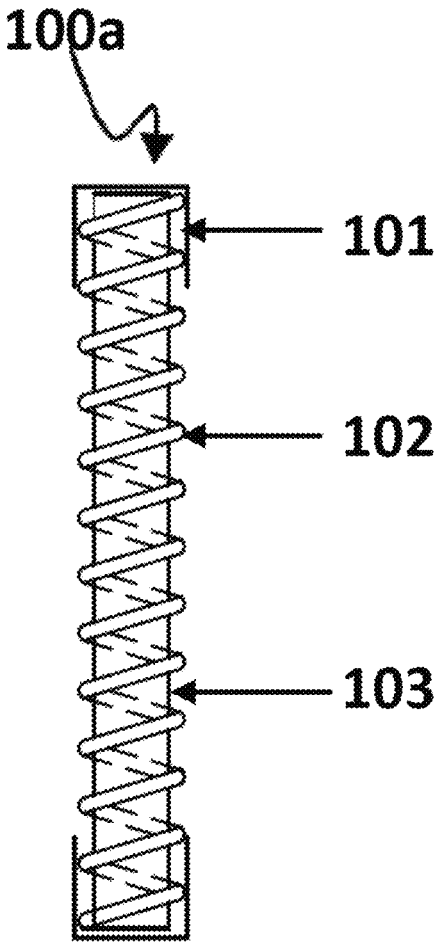
FIG. 1*a* illustrates a single element having one-way spring in a BRSCB with grips at end, according to an embodiment herein.

The embodiments herein and the various features and advantageous details thereof are explained more fully with reference to the non-limiting embodiments and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned above, there is a need for a system to improve lateral confinement of compression system uniformly to withstand both compression and tension. Further, there is a need for a structure to improve ductility when embedded in reinforced concrete structure. The embodiments herein achieve this by providing a Buckling Resistant Spring Clad Bar (BRSCB) with either one-way spring or opposing spring on a bar. Referring now to the drawings, and more particularly to FIGS. 1 through 9, where similar reference characters denote corresponding features consistently throughout the figures, there are shown preferred embodiments.

According to an embodiment, a sleeve-spring clad core system (herein after BRSCB) to improve lateral confinement of compression system uniformly to withstand both compression and tension. The BRSCB comprises, a plurality of bar, a plurality of one-way spring, and a plurality of peripheral ties; wherein the bar is a confinable bar of any material; wherein the one-way spring wrapped around the bar; wherein the diameter of the one-way spring is greater than diameter of the bar; The BRSCB further comprises of a plurality of grips; wherein the grips are provided at least at both the end of the bar to hold the assembly firmly and to avoid end slippage of the one-way spring.

According to an embodiment, the multiple BRSCB can be assembled as a cage of square or circular or any shaped column according to a structure requirement; wherein the structure comprises multiple bars, each cladded with one-way spring with or without grips placed on the circumference and in the body as desired for a given shape of column, securely tied with peripheral ties. Further, the BRSCB can be placed centrally to a sleeve with at least a gap between one-way spring and the sleeve of suitable material; wherein the gap is grouted to get the performance. Further, the sleeve can be either perforated sleeve or plain sleeve. The BRSCB formed with multiple bars and each wrapped with the one-way springs are housed in the sleeve with at least a gap.

According to another embodiment, a BRSCB to improve lateral confinement of compression system uniformly to withstand both compression and tension. Further, the system is designed in such a way so as to improve ductility of the structure when embedded in reinforced concrete. The BRSCB comprises, a plurality of bar, a plurality of counter springs of same coil diameter, a plurality of grips, and a plurality of peripheral ties; wherein the bar is a confinable bar of any material; wherein the counter springs wrapped around bar; wherein the coil diameter of the spring is greater than diameter of the bar; wherein the grips are provided at least at both the end of the bar to hold the assembly firmly and to avoid slippage of the opposing springs; and wherein the bars are securely tied by the peripheral ties at multiple locations to maintain stability of the system.

According to another embodiment, the BRSCB can be placed central to a sleeve with a gap between the opposing spring and the sleeve; wherein the gap is grouted to get the desired performance. Further, the BRSCB can also be formed with multiple bars and each wrapped with clockwise and anticlockwise opposing springs housed in the sleeve with at least gap.

FIG. 1*a* illustrates a single element having one-way spring 100*a* in a BRSCB with grips at end, according to an embodiment. The single element of the BRSCB comprises a bar 103, a one-way spring 102 and an end grip 101; wherein the bar 103 is confinable bar of any material and is cladded with the one-way spring 102. The end grips 101 are provided at both ends of the bar 103, to hold assembly firmly to avoid end slippage. Optionally, intermediate grips are provided to connect the one-way spring and the bar to improve stiffness of the one-way spring.

According to an embodiment, when compression load is applied on cage, each bar can receive a load that is proportional to its capacity. Under axial compression, spring can compress ahead of the bar and increase its capacity for confinement. As the pitch reduces, the capacity of the spring can restrain bar from lateral movement/buckling. Accordingly, the bar assumes multiple curvatures instead of a single profile. As a result, vertical capacity of bar increases, consequently its ability to sustain load increases. This feature results in improved ductility of the structure.

Figure 1B:
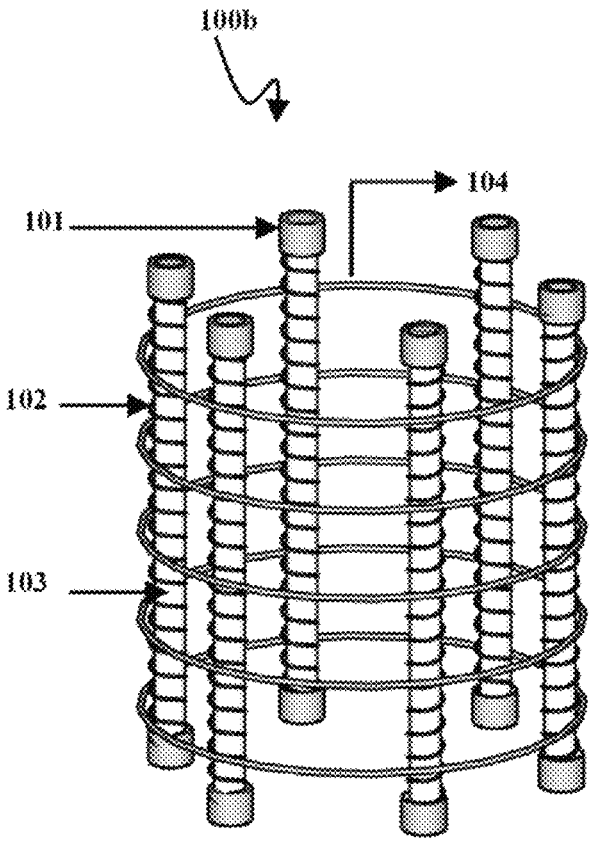
FIG. 1*b* illustrates a cage assembly of a one-way spring in a BRSCB with grips at end, according to an embodiment herein.

FIG. 1*b* illustrates a cage assembly 100*b* of a one-way spring in a BRSCB with grips at end, according to an embodiment. The cage assembly comprises of multiple bars 103 that are connected together by a plurality of peripheral ties 104 at multiple locations to maintain stability of the system. The peripheral ties can securely tie the bars 103 to form the desired shape that includes but is not limited to circular column, square, rectangular and so on. Further, the multiple bars 103 can be placed on the circumference and in the cage body as desired for a given shape of column; wherein each bar 103 is wrapped/cladded with the one-way spring 102 using springs of diameter marginally more than the bar 103.

Figure 1C:
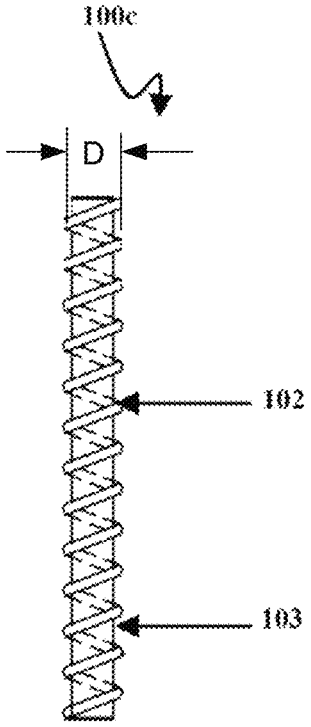
FIG. 1*c* illustrates a single element having one-way spring in a BRSCB without grips at end, according to an embodiment herein.

FIG. 1*c* illustrates a single element having one-way spring 100*c* in a BRSCB without grips at end, according to an embodiment. The single element having one-way spring in the BRSCB can be assembled without grips at end. In this example, the diameter D of the one-way spring 102 is marginally larger than the diameter of the bar 103.

Figure 1D:
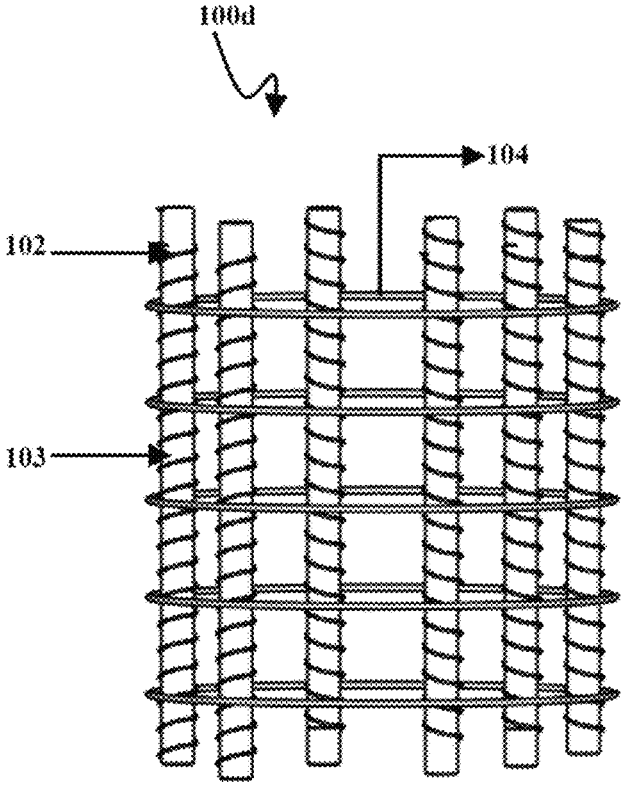
FIG. 1*d* illustrates a cage assembly of a one-way spring in a BRSCB without grips at end, according to an embodiment herein.

FIG. 1*d* illustrates a cage assembly of a one-way spring 100*d* in a BRSCB without grips at end, according to an embodiment. The cage assembly of a one-way spring in the BRSCB can be assembled without grips at end.

Figure 2A:
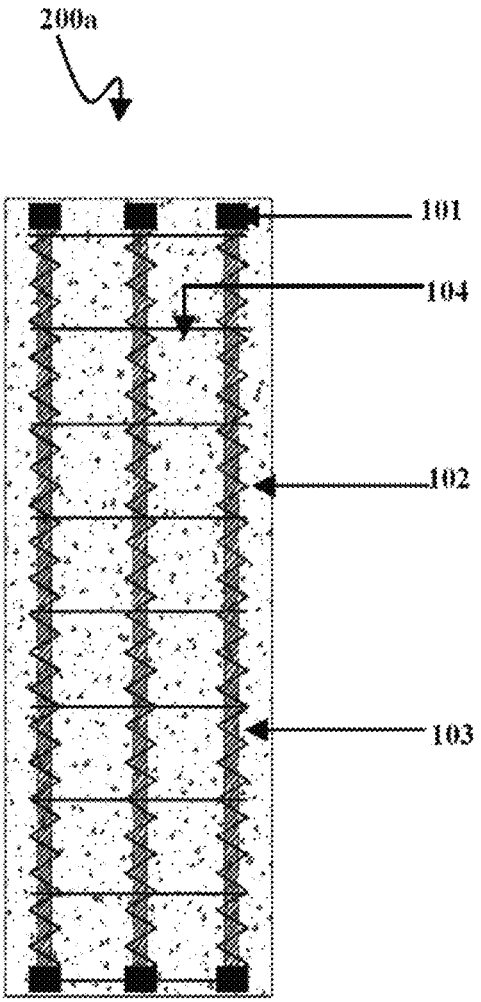
FIG. 2*a* illustrates a concrete structure of a one-way spring in a BRSCB with grips at end, according to an embodiment herein.

FIG. 2*a* illustrates a concrete structure of a one-way spring 200*a* in a BRSCB with grips at end, according to an embodiment. The concrete structure of a one-way spring in a BRSCB can be assembled with end grips 101. The cage assembly can be embedded in the reinforced concrete to improve the ductility and stability of the structure.

Figure 2B:
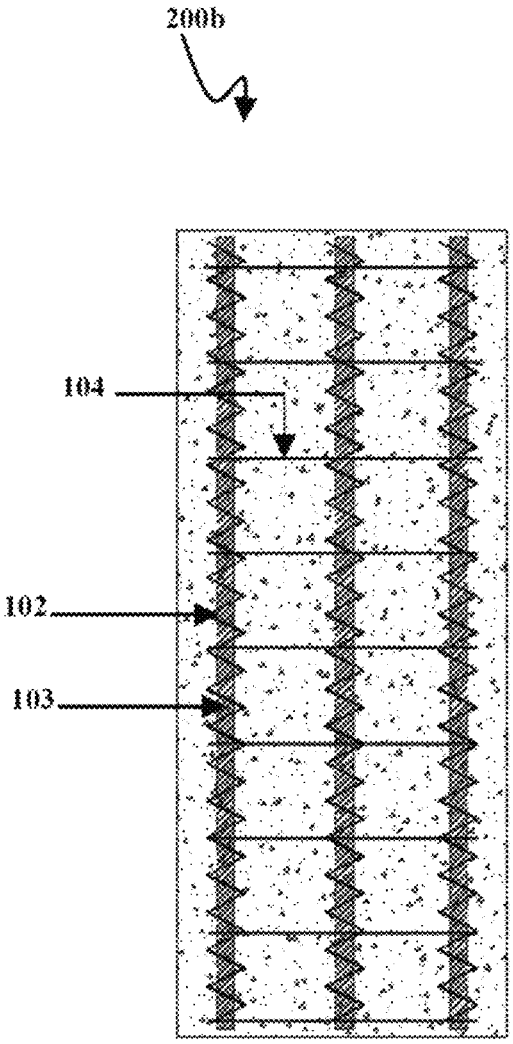
FIG. 2*b* illustrates a concrete structure of a one-way spring in a BRSCB without grips at end, according to an embodiment herein.

FIG. 2*b* illustrates a concrete structure of a one-way spring in a BRSCB without grips at end, according to an embodiment. The concrete structure of a one-way spring in a BRSCB can be assembled without grips at end.

Figure 3A:
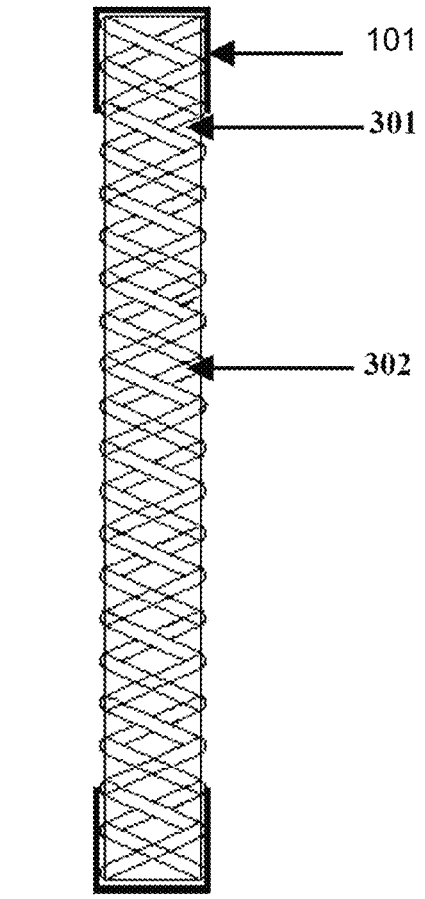
FIG. 3*a* illustrates a single element having an opposing spring in a BRSCB, with grips at end, according to another embodiment herein.

FIG. 3*a* illustrates a single element having opposing spring 300*a* in a BRSCB with grips at end, according to another embodiment. The single element of the counter spring cladded compression system comprises a bar 103, an opposing spring and an end grip 101. The opposing spring comprises clockwise spring 301 and anticlockwise spring 302. One set of clockwise spring 301 and anticlockwise spring 302 is inserted from opposite sides and then the bar 103 is passed through to lock the springs. The springs are of same core diameter and pitch. This arrangement of inserting the bar avoids staggered arrangement. The end grips 101 are provided at both ends of the bar, to hold assembly firmly to avoid end slippage. Optionally, intermediate grips are provided to connect the opposing spring and the bar to improve stiffness of the opposing spring.

Figure 3B:
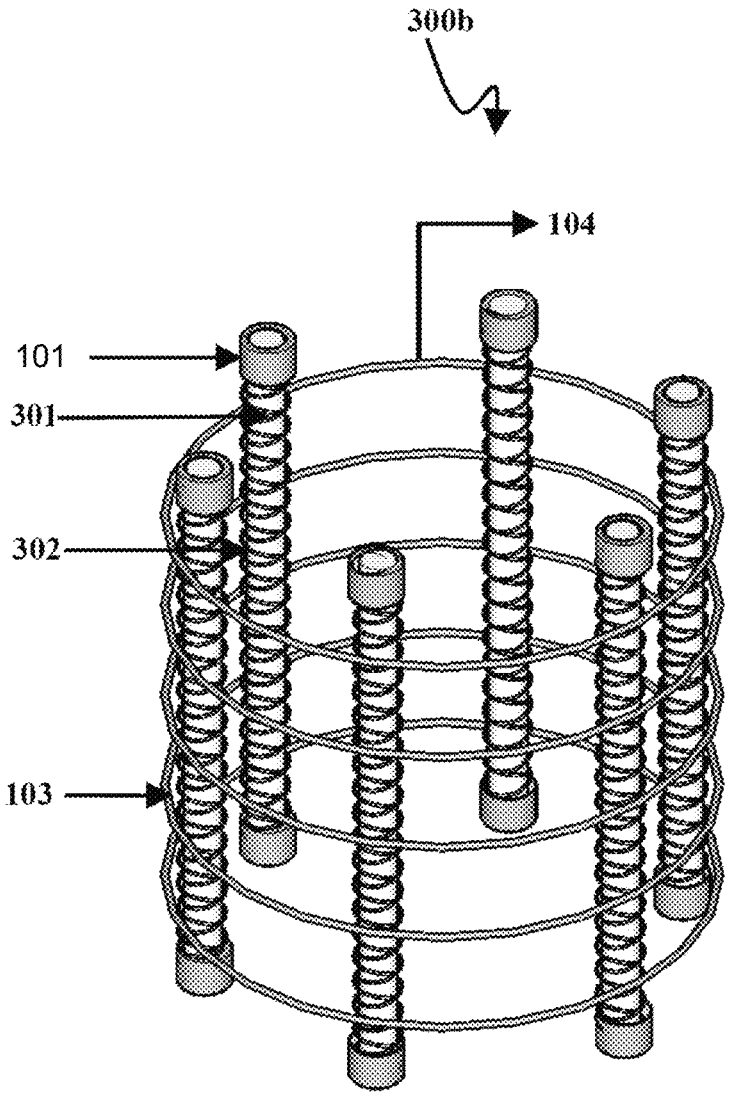
FIG. 3*b* illustrates a cage assembly of an opposing spring in a BRSCB with grips at end, according to another embodiment herein.

FIG. 3*b* illustrates a cage assembly of an opposing spring 300*b* in a BRSCB with grips at end, according to another embodiment. The cage assembly comprises of multiple bars 103 that are connected together by a plurality of peripheral ties 104 at multiple locations to maintain stability of the system. The peripheral ties 104 are spaced apart and disposed at multiple locations along a length of the plurality of bars 103. Adjacent peripheral ties 104 in one example, are spaced apart by a distance "P". In one example, the distance P may be of the order of about 3 inches to about 18 inches. The peripheral ties can securely tie the bars 103 to form the desired shape that includes but is not limited to circular column, square, rectangular and so on. In one example, the peripheral ties 104 may be formed using either a strip, cable, or a rod made of a metal or an alloy of metal. In one example, the peripheral ties may be formed using mild steel rod or high strength steel rod, based on the application. In some examples, high strength steel rod may have deformation patterns on the external surface to promote better bonding with concrete. In one example, the deformation patterns may be in the form of ribs over the surface of the rod. In one example, the peripheral ties 104 are wrapped around the bars 103. Further, the multiple bars 103 can be placed on the circumference and in the cage body as desired for a given shape of column; wherein each bar 103 is wrapped/cladded with the opposing spring (clockwise spring 301 and anti-clockwise spring 302) using springs of diameter marginally more than the bar 103.

Figure 3C:
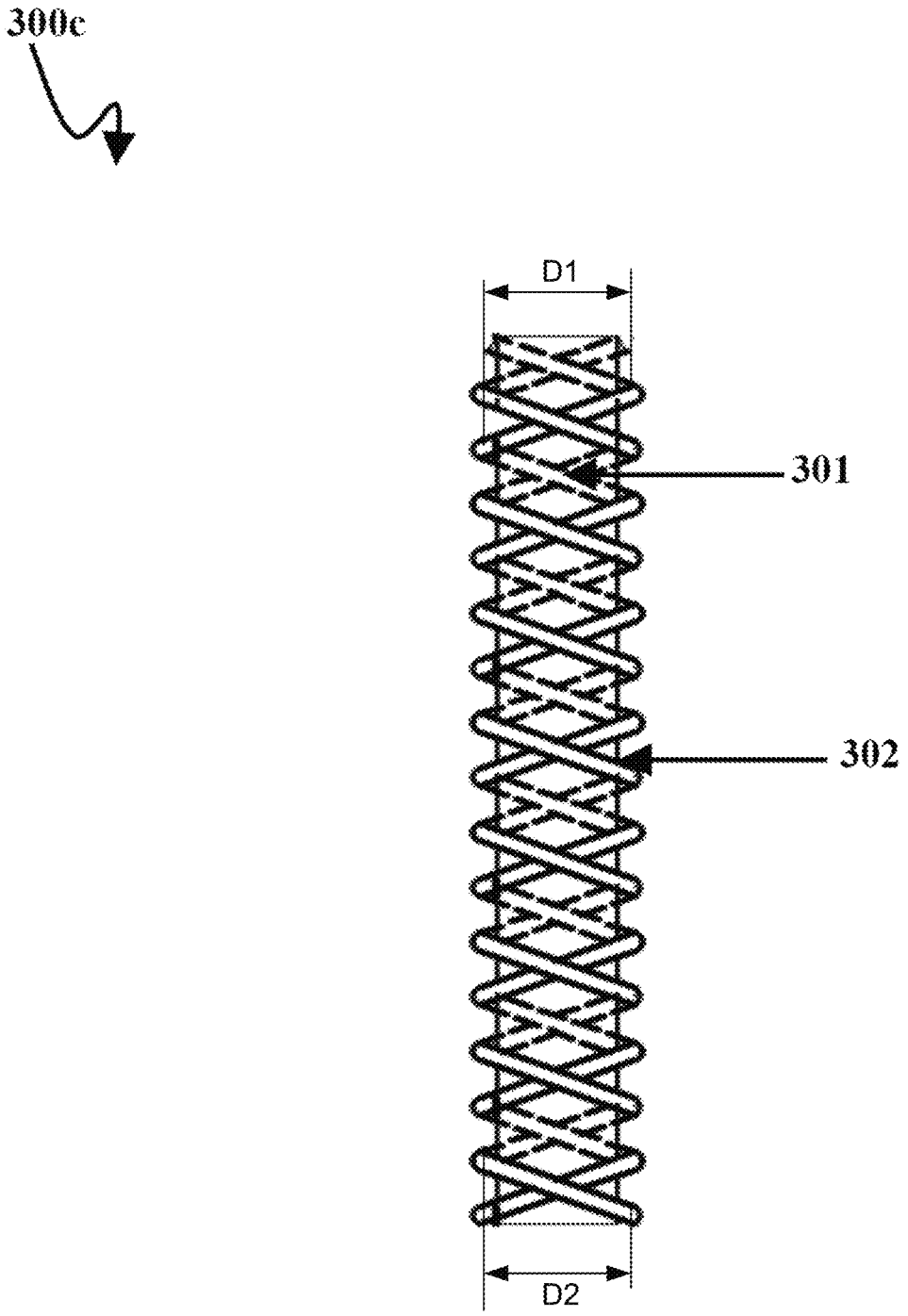
FIG. 3*c* illustrates a single element having an opposing spring in a BRSCB, without grips at end, according to another embodiment herein.

FIG. 3*c* illustrates a single element having opposing spring 300*c* in a BRSCB, without grips at end according to another embodiment. The single element having opposing spring in the BRSCB can be assembled without end grips. In this example, the diameter D1 of the clockwise spring 301 is marginally larger than the diameter of the bar 103. Also, the diameter D2 of the anticlockwise spring 302 is marginally larger than the diameter of the bar 103. In one example, the diameter D1 and D2 may be same. In another example, the diameter D1 and D2 may be different.

Figures 4A, 4B:
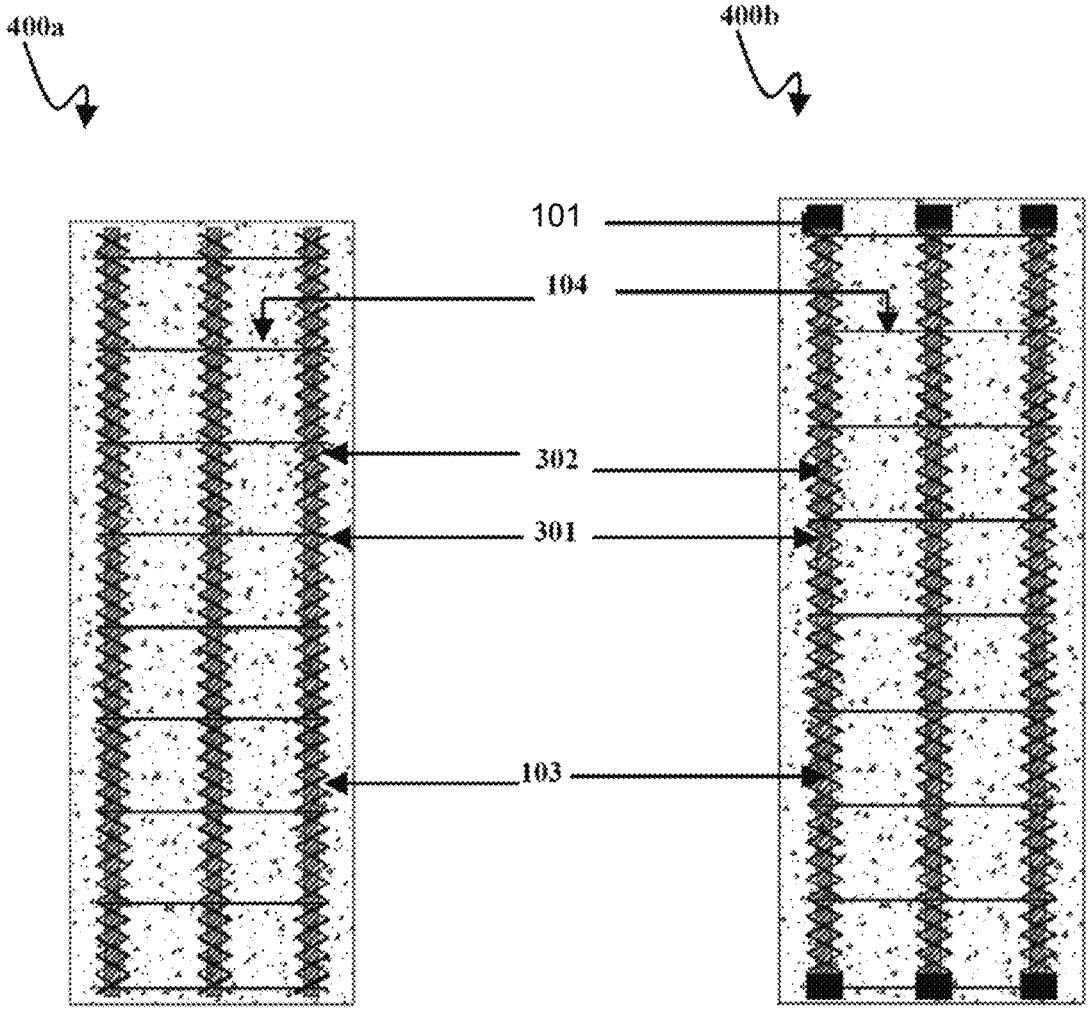
FIG. 4*a* illustrates a concrete structure of an opposing spring in a BRSCB without grips at end, according to another embodiment herein.
FIG. 4*b* illustrates a concrete structure of an opposing spring in a BRSCB with grips at end, according to another embodiment herein.

FIG. 4*a* illustrates a concrete structure of an opposing spring 400*a* in a BRSCB without grips at end, according to another embodiment. The cage assembly can be embedded in the reinforced concrete to improve the ductility and stability of the structure.

FIG. 4*b* illustrates a concrete structure of an opposing spring 400*b* in a BRSCB with grips at end, according to another embodiment. The concrete structure of an opposing spring in a BRSCB can be assembled with end grips 101.

Figure 4C:
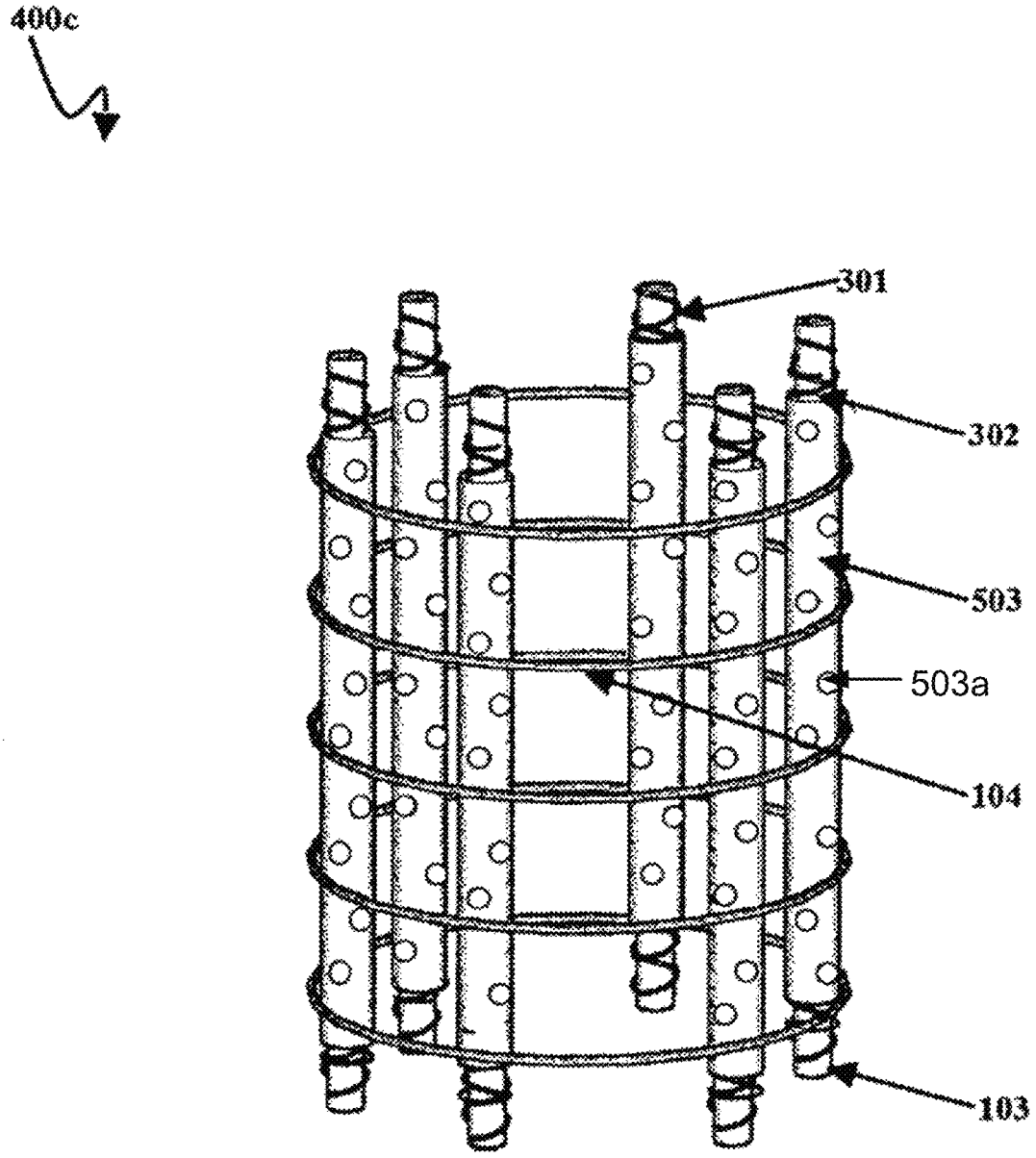
FIG. 4*c* illustrates a cage assembly of an opposing spring in a BRSCB, according to an embodiment herein.

FIG. 4*c* illustrates a cage assembly 400*c* of an opposing spring in a BRSCB with a perforated sleeve, according to another embodiment. The single element of the bar 103 that is wrapped with the opposing spring (clockwise 301 and anticlockwise spring 302) can be embedded in a perforated sleeve 503. The perforated sleeve 503 may be of any material having hoop resistance according to the requirement. In one example, the perforated sleeve 503 may include a plurality of perforations 503*a*. The perforations 503*a* permit flow of concrete or grout into the sleeve 503. In one example, the perforations 503*a* may be of suitable shape and dimension to permit flow of concrete or grout into the sleeve. In some examples, the perforations 503*a* may be shaped as a circles or an ovals. In some examples, the perforations 503*a* may be a shaped as a rectangle opening or as an elongated slot. In some examples, the perforations 503*a* may be dimensioned with an opening area of about 0.1 square inches to about 6 square inches.

The cage assembly 400*c* comprises of multiple bars 103 with sleeve 503 that are connected together by a plurality of peripheral ties 104 at multiple locations to maintain stability of the system. The peripheral ties 104 can securely tie the bars 103 with the sleeve 503 to form the desired shape that includes but is not limited to circular column, square, rectangular and so on. Further the multiple bars 103 with sleeve 503 can be placed on the circumference and in the cage body as desired for a given shape of column. As previously described, each bar 103 is wrapped/cladded with the opposing springs (301 & 302) using springs of diameter marginally more than the bar 103. As one skilled in the art appreciates, the cage assembly 400*c* can be embedded in the reinforced concrete to improve the ductility and stability of the structure.

Figure 5A:
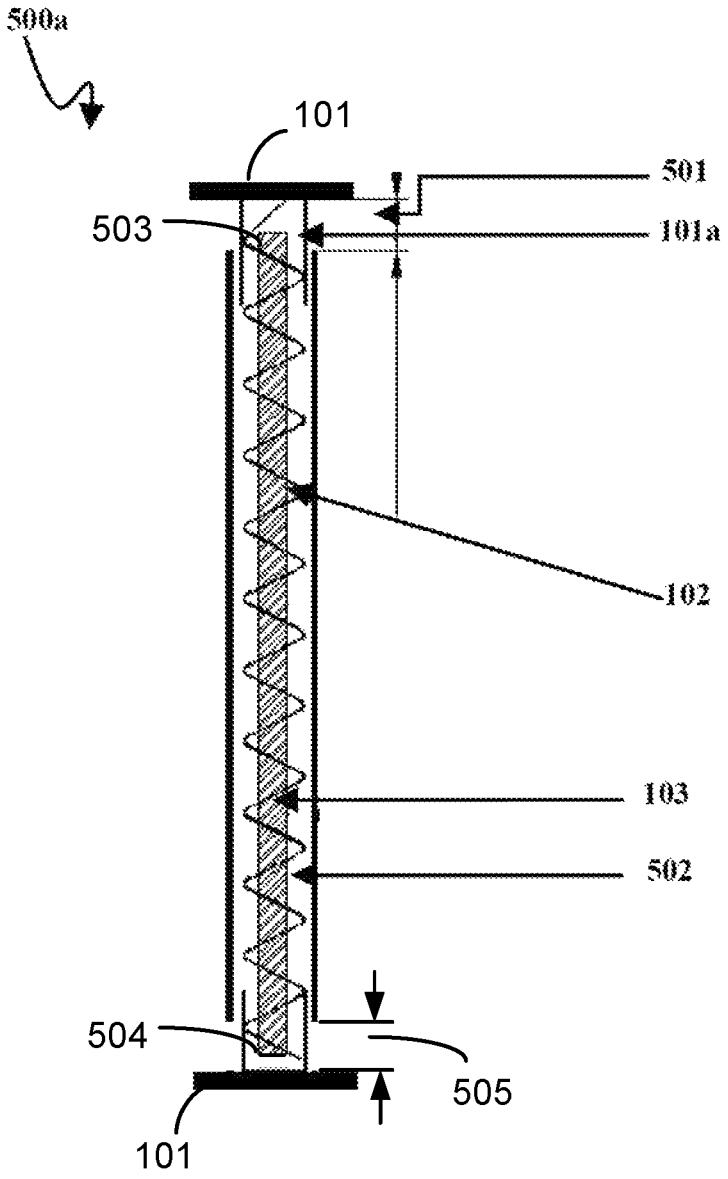
FIG. 5*a* illustrates a single element having one-way spring with sleeve in a BRSCB, according to an embodiment herein.

FIG. 5*a* illustrates a single element having one-way spring with sleeve 500*a* in a BRSCB, according to an embodiment. The single element of the bar 103 that is wrapped with the one-way spring 102 (either clockwise or anticlockwise spring) can be embedded in a sleeve 502 to improve the lateral restraining of bar. The sleeve may have a circular, square or rectangular cross-section. An allowable displacement 501 between end grip 101 and the sleeve 502 is also provided about the top end 503 of the bar 103, to permit vertical movement of the bar 103, along its length, in either direction. Another end grip 101 is disposed about a bottom end 504 of the bar 103. In one example, another allowable displacement 505 may be provided between the sleeve 502 and the end grip 101 disposed about the bottom end 504 of the bar 103. The end grip 101 is coupled to the spring 102 and the bar 103 about the top end 503 and the bottom end 504 of the bar 103.

Figure 5B:
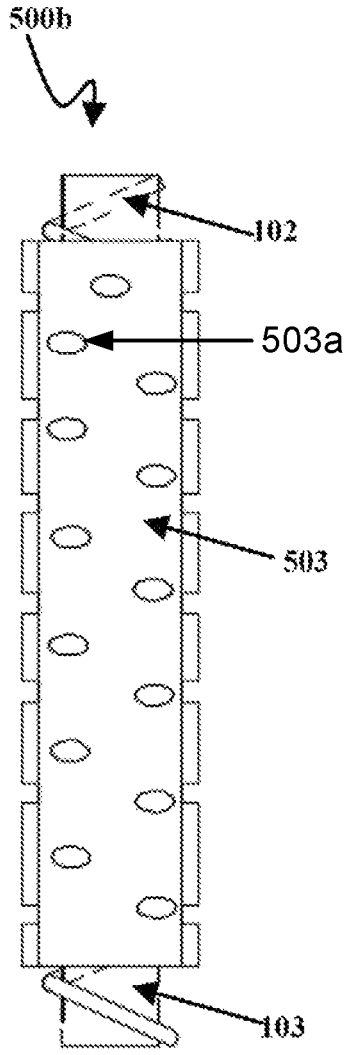
FIG. 5*b* illustrates a single element having one-way spring with perforated sleeve in a BRSCB, according to an embodiment herein.

FIG. 5*b* illustrates a single element having one-way spring with perforated sleeve 500*b* in a BRSCB, according to an embodiment. The single element of the bar 103 that is wrapped with the one-way spring 102 can be embedded in a perforated sleeve 503. The perforated sleeve 503 may be of any material having hoop resistance according to the requirement. In one example, the perforated sleeve 503 may include a plurality of perforations 503*a*. The perforations 503*a* permit flow of concrete or grout into the sleeve 503. In one example, the perforations 503*a* may be of suitable shape and dimension to permit flow of concrete or grout into the sleeve. In some examples, the perforations 503*a* may be shaped as a circles or an ovals. In some examples, the perforations 503*a* may be a shaped as a rectangle opening or as an elongated slot. In some examples, the perforations 503*a* may be dimensioned with an opening area of about 0.1 square inches to about 6 square inches.

Figure 6A:
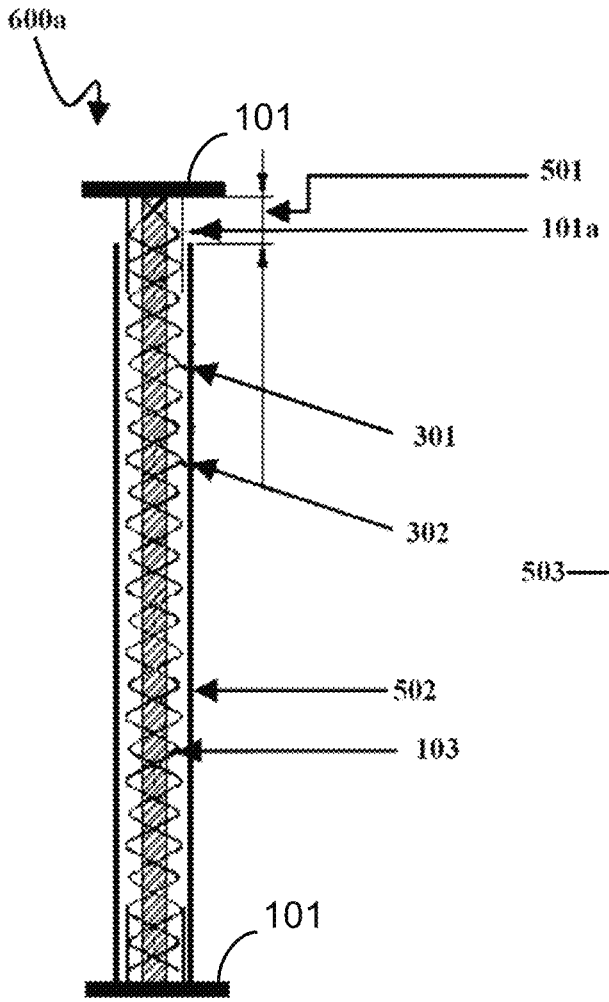
FIG. 6*a* illustrates a single element having opposing spring with sleeve in a BRSCB, according to another embodiment herein.

FIG. 6*a* illustrates a single element having opposing springs with sleeve 600*a* in a BRSCB, according to an embodiment. The single element of the bar 103 that is wrapped with the opposing spring (clock-wise spring 301 and anticlockwise spring 302) can be embedded in a sleeve 502 to improve the structure stability. An allowable displacement 501 between end grip 101 and the sleeve is also provided.

Figure 6B:
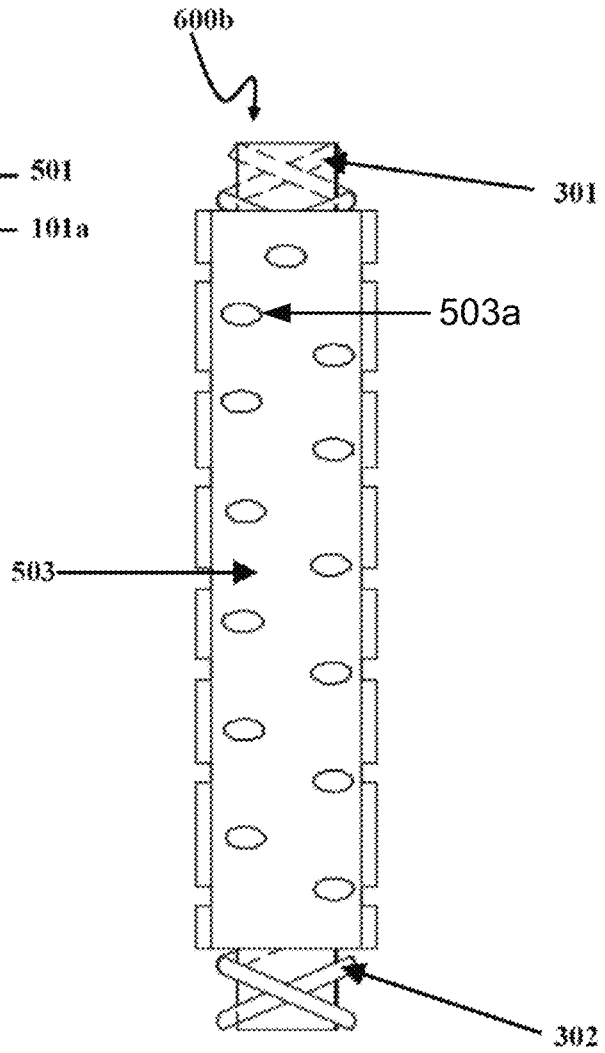
FIG. 6*b* illustrates a single element having opposing spring placed in a perforated sleeve, according to another embodiment herein.

FIG. 6*b* illustrates a single element having opposing springs placed in a perforated sleeve 600*b*, according to another embodiment. The single element of the bar 103 that is wrapped with the opposing springs (clock-wise spring 301 and anticlockwise spring 302) can be embedded in a perforated sleeve 503. The perforated sleeve 503 may be of any material having hoop resistance according to the requirement. In one example, the perforated sleeve 503 may include a plurality of perforations 503*a*. The perforations 503*a* permit flow of concrete or grout into the sleeve 503. In one example, the perforations 503*a* may be of suitable shape and dimension to permit flow of concrete or grout into the sleeve. In some examples, the perforations 503*a* may be shaped as a circles or an ovals. In some examples, the perforations 503*a* may be a shaped as a rectangle opening or as an elongated slot. In some examples, the perforations 503*a* may be dimensioned with an opening area of about 0.1 square inches to about 6 square inches.

Figure 7A:
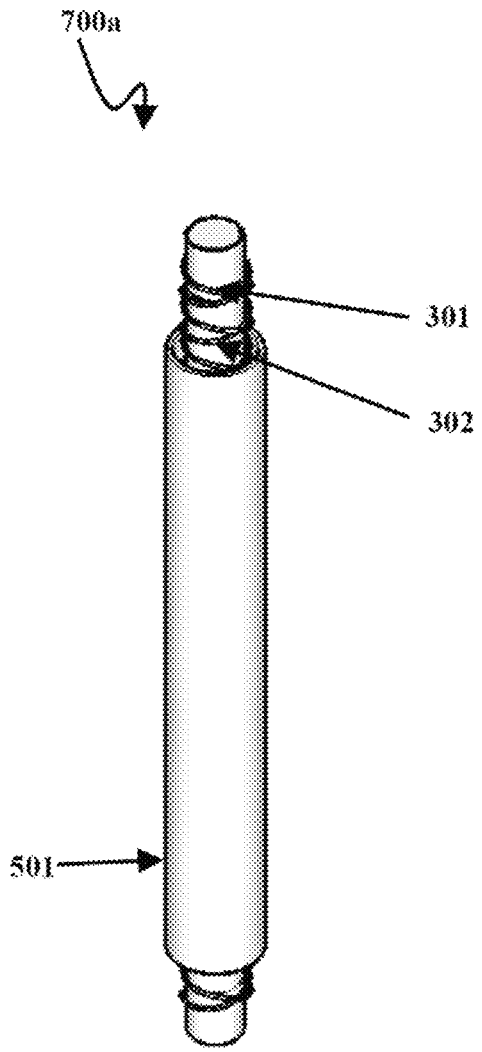
FIG. 7*a* illustrates perspective view of a single core having opposing spring placed in a sleeve, according to another embodiment herein.

FIG. 7*a* illustrates perspective view of a single element having opposing springs placed in a sleeve 700*a*, according to an embodiment. In between the sleeve and the single bar an allowable gap is provided. Each bar 102 is wrapped with the opposing springs (clock-wise spring 301 and anticlockwise spring 302). The gap is grouted to get the desired performance and reduce friction. In some cases, there may not be any requirement for the gap.

Figure 7B:
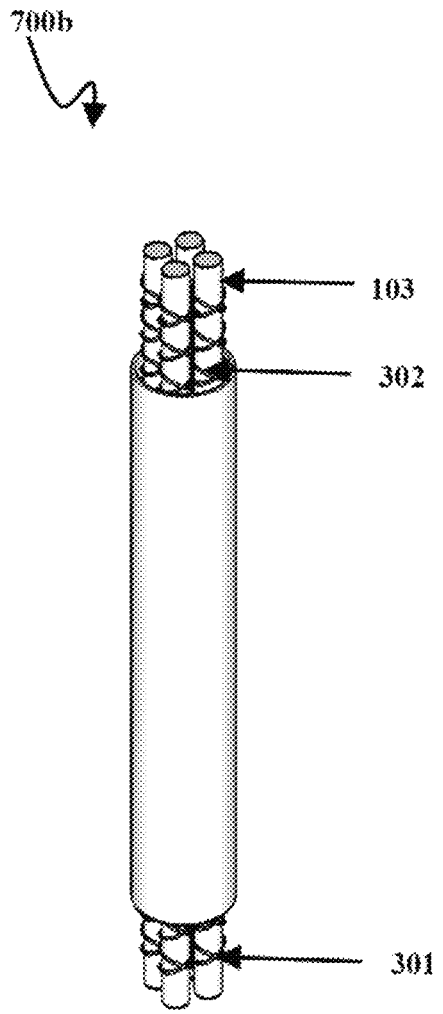
FIG. 7*b* illustrates perspective view of a multiple core having opposing spring placed in a sleeve, according to another embodiment herein.

FIG. 7*b* illustrates perspective view of a single rebar having opposing springs placed in a sleeve 700*b*, according to another embodiment. The multiple bars 103, each wrapped with the opposing springs (301 and 302) are also housed in the sleeve 502 for higher load carrying capacity and ductility improvement. The same can be implemented for the bar 103 each wrapped with one-way spring.

Figure 8A:
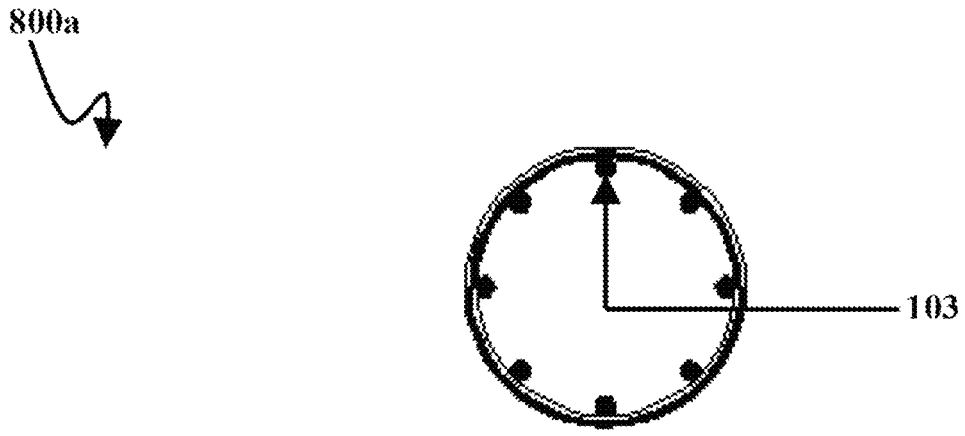
FIG. 8*a* illustrates a top view of a concrete cage structure of an opposing spring in a BRSCB with multiple bar, according to another embodiment herein.

FIG. 8*a* illustrates a top view 800*a* of a circular shape concrete structure of an opposing spring in a BRSCB, according to an embodiment. The top view of the circular shape concrete structure of an opposing spring in the BRSCB shows the bars 103. The bars are arranged in such a way to obtain the circular shape for the concrete structure.

Figure 8B:
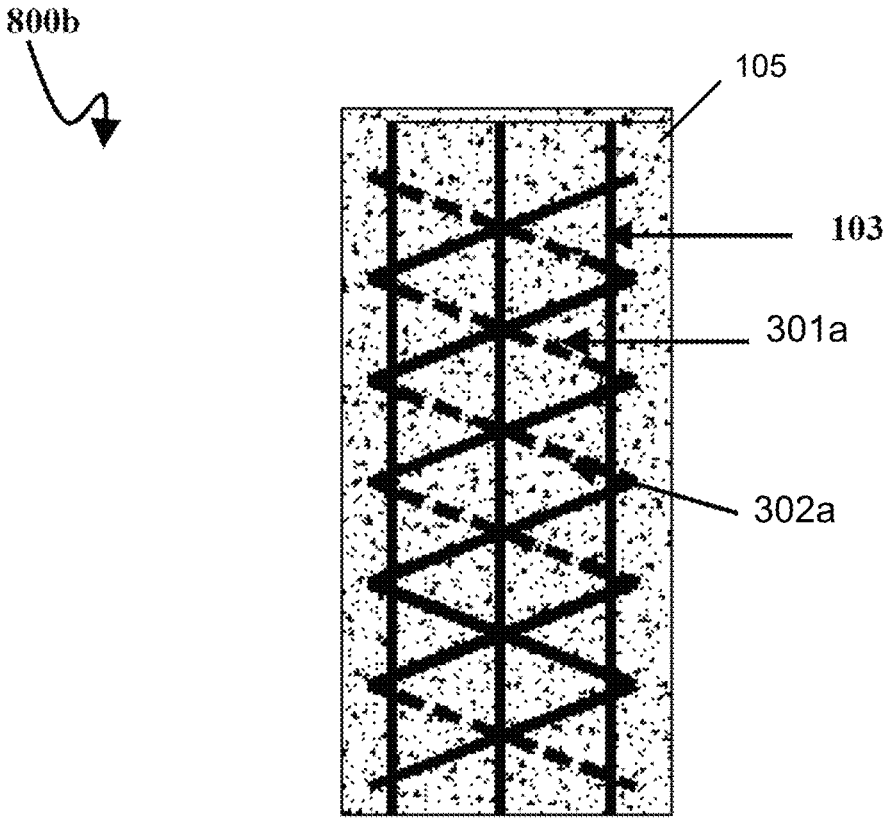
FIG. 8*b* illustrates a side view of a concrete cage structure of an opposing spring in a BRSCB with multiple bar, according to another embodiment herein.

FIG. 8*b* illustrates a side view 800*b* of a circular shape concrete structure of an opposing spring in a BRSCB, according to an embodiment. In the circular shape concrete structure, the bars 103 are collectively wrapped with opposing (clockwise spring tie 301*a* and anticlockwise spring tie 302*a*) spring ties that are inserted into each other and placed at the periphery or the circumference of the cage assembly. The cage assembly is surrounded by concrete 105 of suitable strength, based on the application. In one example, no peripheral ties are used to confine the bars 103, as the opposing spring ties 301*a* and 302*a* provide the confinement for the bars 103. In one example, the bars 103 may be collectively wrapped with one of the spring tie (either clockwise spring tie 301*a* or anticlockwise spring tie 302*a*) placed at the periphery or circumference of the cage assembly. In one example, the spring tie may have a variable diameter, (for example, a tapered shaped spring tie), which may be used to configure a tapered column, varying in diameter, along the length of the bars.

Figure 9A:
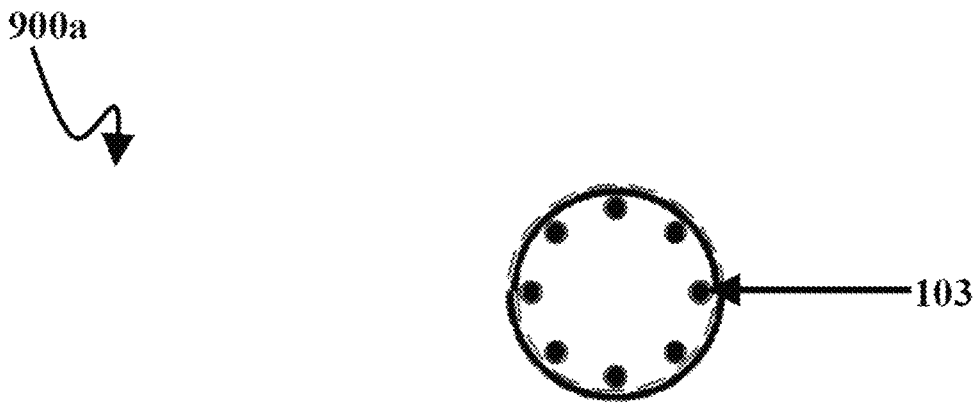
FIG. 9*a* illustrates a top view of a concrete cage structure of an opposing spring in a BRSCB with multiple bar, each rod wrapped with one-way spring, according to another embodiment herein.
Figure 9B:
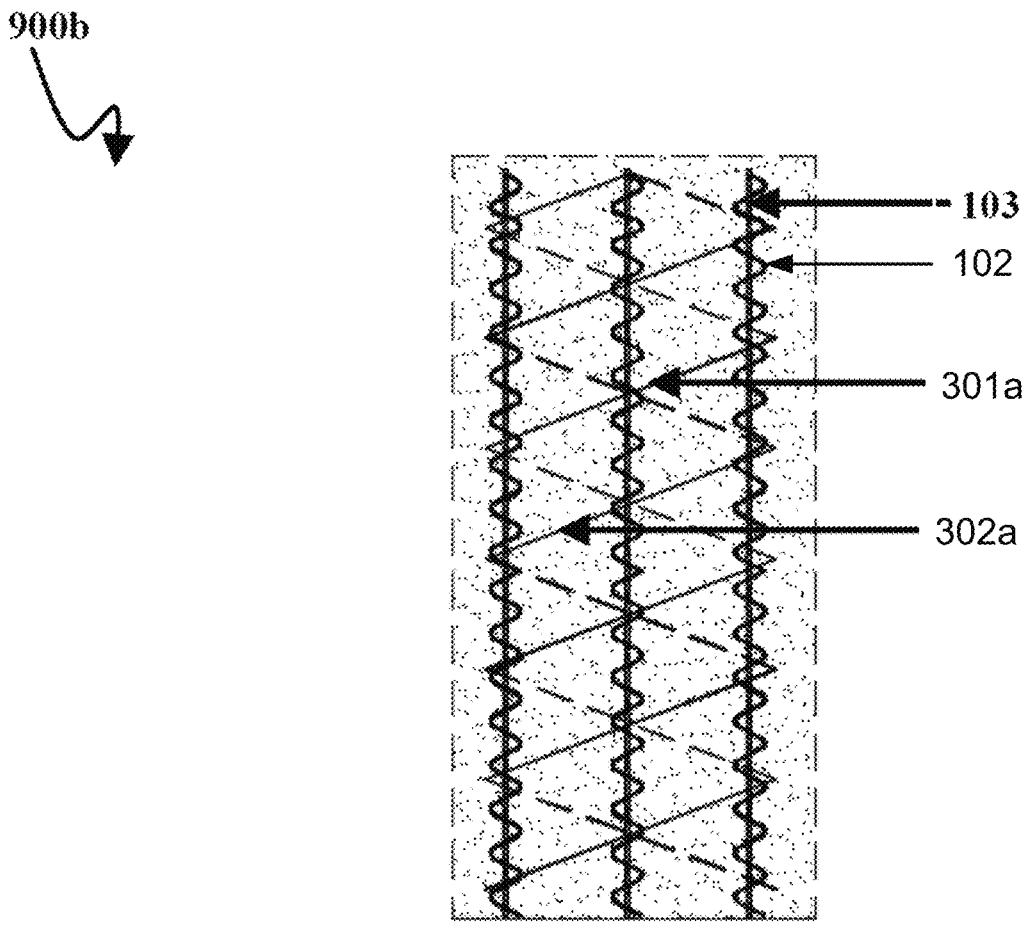
FIG. 9*b* illustrates a side view of a concrete cage structure of an opposing spring in a BRSCB with multiple bar, each rod wrapped with one-way spring, according to another embodiment herein.

FIG. 9*a* illustrates a top view 900*a* of a concrete cage structure of an opposing spring in a BRSCB with multiple bar, each rod wrapped with one-way spring 102, according to an embodiment. FIG. 9*b* illustrates a side view 900*b* of a concrete cage structure of an opposing spring in a BRSCB with multiple bar, each rod wrapped with one-way spring 102, according to an embodiment. In the circular shape concrete structure, bar wrapped with one-way spiral spring 102, the bars 103 that are wrapped with opposing (clockwise spring tie 301*a* and anticlockwise spring tie 302*a*) spring ties are inserted into each other and placed at the periphery or the circumference of the cage assembly. In one example, no peripheral ties are used to confine the bars 103, as the opposing spring ties 301*a* and 302*a* provide the confinement for the bars 103.

Figure 10A:
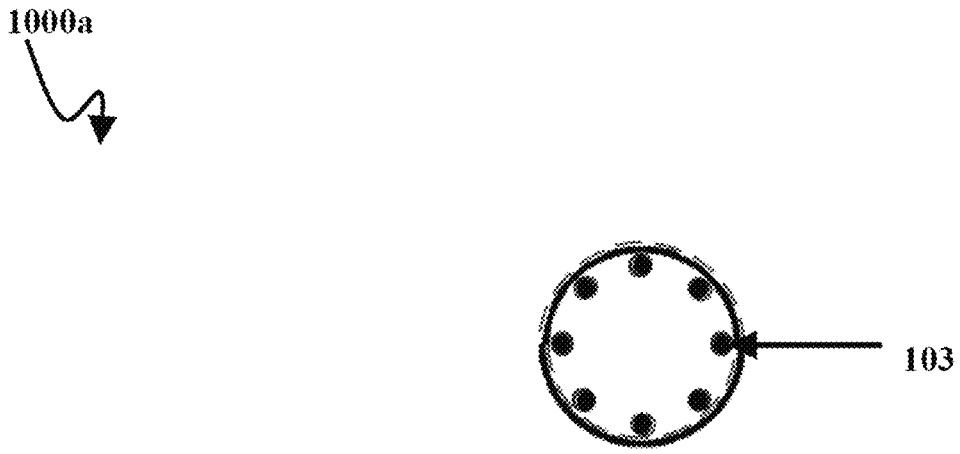
FIG. 10*a* illustrates a top view of a concrete cage structure of an opposing spring in a BRSCB with multiple bar, each rod wrapped with opposing spring, according to another embodiment herein.

FIG. 10*a* illustrates a top view 1000*a* of a concrete cage structure of an opposing spring in a BRSCB with multiple bar, each rod wrapped with opposing spring, according to an embodiment. The top view of a concrete cage structure of an opposing spring in a BRSCB with multiple bars, with each bar 103 wrapped with opposing (clockwise 301 and anticlockwise 302) springs is shown. The bars 103 are collectively wrapped with opposing (clockwise spring tie 301*a* and anticlockwise spring tie 302*a*) spring ties arranged in such a way to obtain the circular shape for the concrete structure.

Figure 10B:
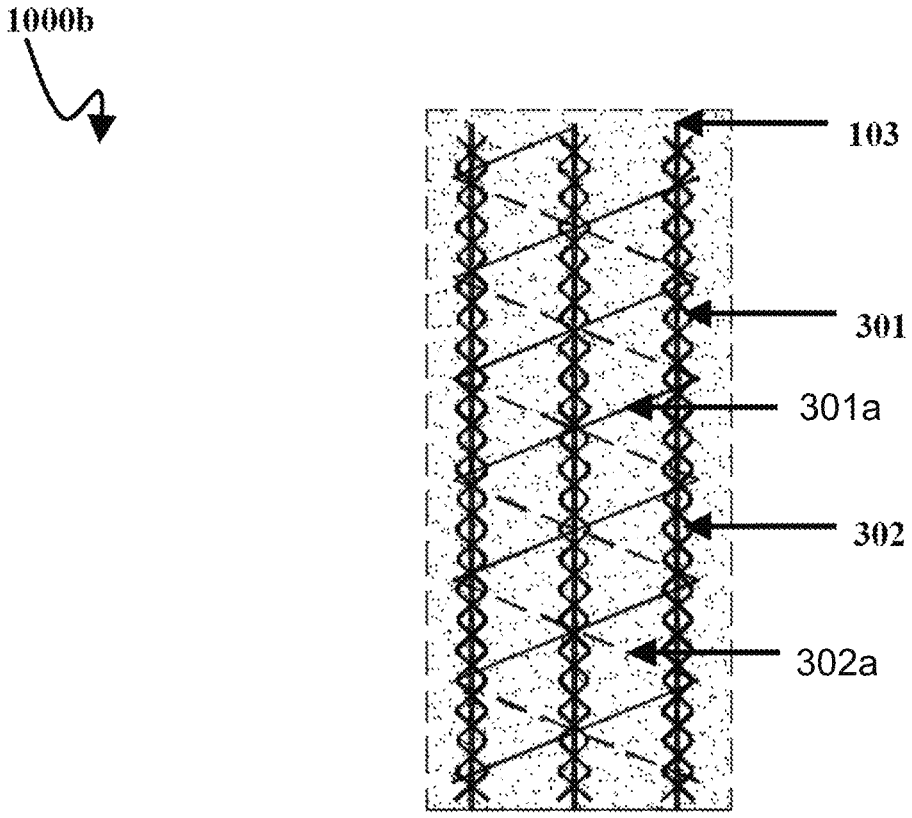
FIG. 10*b* illustrates a side view of a concrete cage structure of an opposing spring in a BRSCB with multiple bar, each rod wrapped with opposing spring, according to another embodiment herein.

FIG. 10*b* illustrates a side view 1000*b* of a concrete cage structure of an opposing spring in a BRSCB with multiple bar, each rod 103 wrapped with opposing spring (clockwise spring 301 and anticlockwise spring 302), according to an embodiment. In the circular shape concrete structure, each bar 103 wrapped with opposing spiral (clockwise spring 301 and anticlockwise spring 302) springs are collectively inserted into opposing spiral springs (clockwise spring tie 301*a* and anticlockwise spring tie 302*a*). The opposing spiral spring ties 301*a* and 302*a* are inserted into each other and placed at the periphery or the circumference of the cage assembly. In one example, no peripheral ties are used to confine the bars 103, as the opposing spring ties 301*a* and 302*a* provide the confinement for the bars 103.

Figure 11:
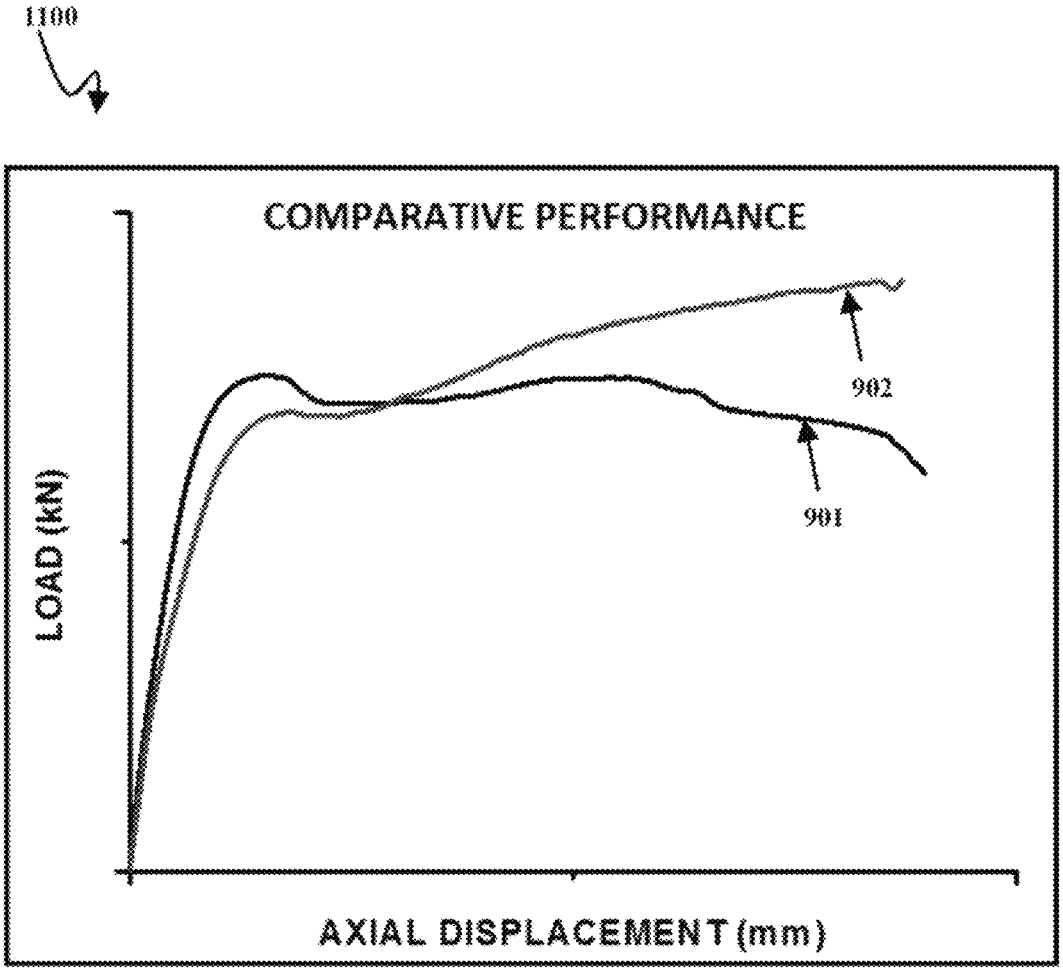
FIG. 11 illustrates a comparison graph between conventional concrete and a BRSCB, according to an embodiment herein.

FIG. 11 illustrates a comparison graph 1100 between conventional concrete and a BRSCB according to an embodiment. The comparison graph between conventional concrete with bars and peripheral ties passively embedded in concrete and a Buckling Resistant Spring Clad Bar (BRSCB) with bar wrapped with opposing springs, passively embedded in concrete. A graphical representation between load and axial displacement can clearly shows the improvement in ductility of the structure. The load applied is in Kilo Newton and axial displacement that is measured is in mm. When the load is applied on the specimen, the axial displacement for a conventional reinforced concrete specimen with circular hoops/peripheral ties 901 increases and at one point onwards, it starts loosing capacity rapidly indicating reduced ductility. However, when the load is applied on the specimen, the axial displacement for a reinforced concrete specimen with opposing spring cladded bar & ties 902 shows stable increase in axial displacement without appreciable loss of capacity indicating appreciable improvement in ductility.

In various examples described above, peripheral ties 104 are used. The peripheral ties 104 may be spaced apart and disposed at multiple locations along a length of the plurality of bars 103. Adjacent peripheral ties 104 in one example, are spaced apart by a distance "P". In one example, the distance P may be of the order of about 3 inches to about 18 inches. The peripheral ties can securely tie the bars 103 (with or without a sleeve surrounding the bars 103) to form the desired shape that includes but is not limited to circular column, square, rectangular and so on. In one example, the peripheral ties 104 may be formed using either a strip, cable, or a rod made of high strength metal or an alloy of metal. In one example, the peripheral ties may be formed using high strength steel rod. In some examples, high strength steel rod may have deformation patterns on the external surface to promote better bonding with concrete. In one example, the peripheral ties 104 are wrapped around the bars 103.

In some examples, the end grips described in one or more examples above may be formed of a metal or alloy of metal. In one example, the end grips may be a plate selectively welded to the bars so as to prevent slippage of the spring relative to the bar. In some examples, the end grips may be formed in the shape of a cylindrical ring, with a diameter greater than the diameter of the spring and selectively welded to the ends of the bars so as to prevent slippage of the spring relative to the bar. In some examples, the end grips may be made of metal or an alloy of metal that is crimped inside and configured to receive and clamp the bar and the spring at the ends of the bar. In some examples, ends of the spring may also be welded to the end grips. In some examples, ends of the spring may be welded to the bars. In some examples where the ends of the spring is welded to the bars, there may not be a need for an end grip at the end of the bars.

In some examples, a plurality of one-way springs may be used to wrap around the bars 103, which are spaced apart (or phased apart) from each other along a length of the bars 103. For example, these one-way springs may all be either clockwise springs or anti-clockwise springs. In one example, the one-way springs may have different diameters, varying the gap between the bar and the spring, along the length of the bar.

In some examples, a plurality of opposing springs may be used to wrap around the bars 103, which are spaced apart (or phased apart) from each other along a length of the bars 103. For example, these opposing springs may be a combination of a plurality of clockwise springs and a plurality of anti-clockwise springs. In one example, the opposing springs may have different diameters.

In some examples, an implicit system may refer to an application where various example implementations of BRSCB described above is embedded in concrete. In some examples, an explicit system may refer to an application where various example implementations of BRSCB described above is not embedded in concrete. In some examples, the BRSCB described above wherein the springs wrapped around the bar will constrain the lateral buckling of the bar, for example, due to a seismic or earthquake event.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

We claim:

1. A buckling resistant spring clad bar (BRSCB) assembly comprising:

a plurality of bars arranged to form a perimeter, each of the plurality of bars having a top end and a bottom end;

a plurality of lateral restraint elements, each lateral restraint element wound in the shape of a spring;

wherein at least one of the plurality of lateral restraint element is wrapped around each of the plurality of bars;

wherein a diameter of the at least one of the plurality of lateral restraint element is greater than a diameter of the each of the plurality of bars; and wherein the at least one of the plurality of lateral restraint element is wrapped around each of the plurality of bars in close contact to provide a substantially uniform lateral restraint against buckling along the length of each of the plurality of bars against a load applied over each of the plurality of bars and cause deformation of the plurality of bars with multiple curvatures.

2. The BRSCB assembly of claim 1, further including:

a plurality of peripheral ties disposed along a plurality of locations along a length of the plurality of bars, between the top end and the bottom end, the plurality of peripheral ties bounding the perimeter and securely tying the plurality of bars.

3. The BRSCB assembly of claim 1, further including:

at least one spring tie disposed along a length of the plurality of bars, between the top end and the bottom end, the at least one spring tie bounding the perimeter and securely tying the plurality bars.

4. The BRSCB assembly of claim 3, further including:

a plurality of spring ties disposed along a length of the plurality of bars, between the top end and the bottom end, the plurality of spring tie bounding the perimeter and securely tying the plurality bars.

5. The BRSCB assembly of claim 4, wherein, at least one of the plurality of spring ties is a spring wound in a clockwise direction and at least another one of the plurality of spring ties is a spring would in an anticlockwise direction.

6. The BRSCB assembly of claim 3, wherein, the spring tie is a spring wound in one direction, either clockwise direction or anticlockwise direction.

7. The BRSCB assembly of claim 1, wherein, a plurality of lateral restraint elements are disposed about each of the bars.

8. The BRSCB assembly of claim 7, wherein, the plurality of lateral restraint elements are wound in one direction, either clockwise direction or anticlockwise direction.

9. The BRSCB assembly of claim 7, wherein, at least one of the plurality of lateral restraint elements is wound in a clockwise direction and at least another one of the plurality of lateral constraining element is wound in an anticlockwise direction.

10. The BRSCB assembly of claim 9, wherein, at least one spring tie disposed along a length of the plurality of bars, between the top end and the bottom end, the at least one spring tie bounding the perimeter and securely tying the plurality bars.

11. The BRSCB assembly of claim 9, wherein, the at least one of the plurality of lateral restraint elements wound in the clockwise direction and the at least another one of the plurality of lateral constraining element wound in the anticlockwise direction are interposed with each other.

12. The BRSCB assembly of claim 1, wherein the at least one of the plurality of lateral restraint element wrapped around each of the plurality of bars is held in place without end grips.

13. A buckling resistant spring clad bar (BRSCB) assembly comprising:

a bar having a top end and a bottom end;

a spring;

the spring wrapped around the bar, wherein a diameter of the spring is greater than a diameter of the bar;

a sleeve surrounding the bar and the spring, the sleeve spaced apart from the bar and the spring;

a first end grip disposed about the top end of the bar and coupled to the bar and the spring, wherein a gap is disposed between the end of the sleeve and the first end grip about the top end of the bar to permit vertical movement of the bar; and a second end grip disposed about the bottom end of the bar and coupled to the bar and the spring, wherein another gap is disposed between another end of the sleeve and the second end grip about the bottom end of the bar to permit vertical movement of the bar.

14. The BRSCB assembly of claim 13, wherein, a plurality of springs are disposed about the bar.

15. The BRSCB assembly of claim 14, wherein, the plurality of springs are wound in one direction, either clockwise direction or anticlockwise direction.

16. The BRSCB assembly of claim 14, wherein, at least one of the plurality of springs is wound in a clockwise direction and at least another one of the plurality of springs is wound in an anticlockwise direction.

17. The BRSCB assembly of claim 13, wherein, the sleeve includes a plurality of perforations along a length of the sleeve, to permit concrete or grout to flow into the sleeve.

18. The BRSCB assembly of claim 13, wherein, a plurality of bars with at least one spring wrapped around each of the bar is disposed inside the sleeve.

19. The BRSCB assembly of claim 18, wherein, a plurality of springs are wrapped around each of the bar.

20. The BRSCB assembly of claim 19, wherein, the plurality of springs are wound in one direction, either clockwise direction or anticlockwise direction.

21. The BRSCB assembly of claim 19, wherein, at least one of the plurality of springs is wound in a clockwise direction and at least another one of the plurality of springs is wound in an anticlockwise direction.

22. A buckling resistant spring clad bar (BRSCB) assembly comprising:

a plurality of bars arranged to form a perimeter, each of the plurality of bars having a top end and a bottom end; and a plurality of spring ties disposed along a length of the plurality of bars, between the top end and the bottom end, the plurality of spring ties bounding the perimeter and securely tying the plurality bars, wherein the plurality of spring ties are wound in the shape of a spring, wherein, at least one of the plurality of spring ties is a spring wound in a clockwise direction and at least another one of the plurality of spring ties is another spring wound in an anticlockwise direction.

23. The BRSCB assembly of claim 22, further including:

a plurality of lateral restraint elements, each lateral restraint element wound in the shape of a spring;

wherein, a plurality of the lateral restraint elements are disposed about each of the plurality of bars; and wherein, at least one of the plurality of lateral restraint element is wound in a clockwise direction and at least another one of the plurality of lateral restraint element is wound in an anticlockwise direction.

24. The BRSCB assembly of claim 22, wherein the plurality of bars and the plurality of spring ties together are substantially surrounded by concrete.

* * * * *